US008721841B2

(12) United States Patent
Hautala

(10) Patent No.: US 8,721,841 B2
(45) Date of Patent: May 13, 2014

(54) PULPER TREATING FIBER MASS

(75) Inventor: Jouko Hautala, Tampere (FI)

(73) Assignee: Tampulping Oy (FI)

( * ) Notice: Subject to any disclaimer, the term of this patent is extended or adjusted under 35 U.S.C. 154(b) by 110 days.

(21) Appl. No.: 13/321,553

(22) PCT Filed: May 19, 2010

(86) PCT No.: PCT/FI2010/000033

§ 371 (c)(1),
(2), (4) Date: Nov. 21, 2011

(87) PCT Pub. No.: WO2010/133749

PCT Pub. Date: Nov. 25, 2010

(65) Prior Publication Data

US 2012/0067536 A1 Mar. 22, 2012

(30) Foreign Application Priority Data

May 19, 2009 (FI) ..... 20090197

(51) Int. Cl.
*D21B 1/14* (2006.01)
*D21B 1/34* (2006.01)
*B02C 18/00* (2006.01)

(52) U.S. Cl.
CPC ..... *D21B 1/345* (2013.01); *D21B 1/347* (2013.01); *B02C 18/0092* (2013.01)
USPC ..... 162/261; 162/251; 162/57; 162/58; 241/46.17; 241/51

(58) Field of Classification Search
CPC .... D21B 1/345; D21B 1/347; B02C 18/0092; B02C 23/36
USPC ..... 162/55, 56, 251, 261; 241/46.17
See application file for complete search history.

(56) References Cited

U.S. PATENT DOCUMENTS 3,986,676 A * 10/1976 Husmann ..... 241/51
4,167,249 A * 9/1979 Kohrs ..... 241/46.17
4,460,132 A * 7/1984 Thumm et al. ..... 241/46.11
6,149,015 A * 11/2000 Aikawa ..... 209/273
6,379,505 B1 * 4/2002 Wiljan et al. ..... 162/261

* cited by examiner

*Primary Examiner* — Anthony Calandra
(74) *Attorney, Agent, or Firm* — Galbreath Law Offices, P.C.; John A. Galbreath

(57) ABSTRACT

Pulper used in the paper industry that processes pulp which pulper comprises a pulper container (19), a punched plate screen (15) installed to the mentioned container, a binnacle (8) out of the lower part (3) of the container for the mass that has penetrated the punched plate screen (15) and a rotating mixing rotor located in the container (19) and equipped with wings (1); (5) the purpose of which mixing rotor is to defibrate paper and mix the mass in the container (19) and that the mixing rotor further comprises a cylinder part (20) directed downwards towards the punched plate screen (15) and that rotates along the mentioned rotor to which cylinder part wings (2) that clean the punched plate screen (15) are attached and which cylinder part (20) is located between the mixing rotor and the punched plate screen (15). The pulper comprises a dilution arrangement of the pulp that streams towards the punched plate screen (15) in which dilution arrangement the dilution water is brought along the pipework (9) inside the cylinder part (20) and is directed from the gaps (13) of the cylinder part to be mixed with the pulp stream before the mentioned stream has faced the cleaning wings (2) and the punched plate screen (15) in which case the consistency of the mass is adjusted to be thinner than in the pulping space (16) during the mixing.

6 Claims, 1 Drawing Sheet

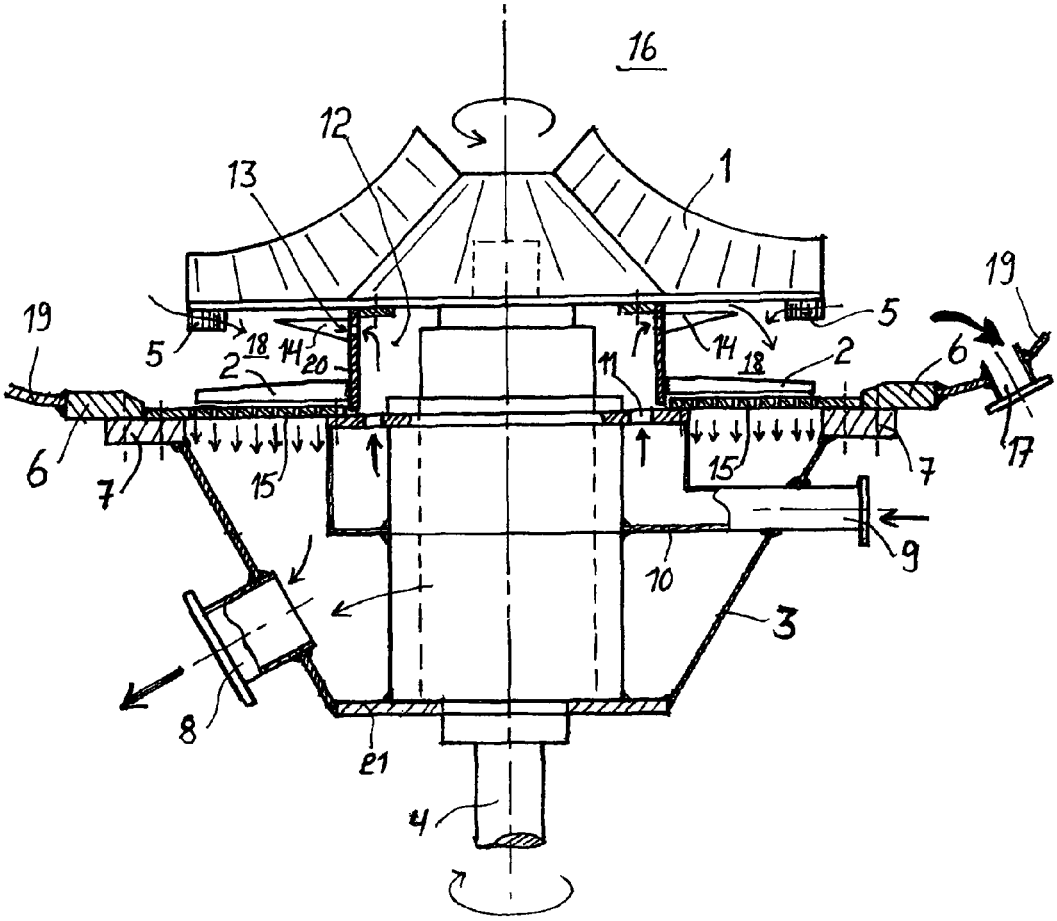
16
12
13
1
19
19
5
5
18
14
20
2
14
18
2
11
6
6
7
15
15
7
17
9
10
3
8
21
4

PULPER TREATING FIBER MASS

The invention relates to a pulper used in paper industry and that processes fiber mass which pulper comprises a pulper container, a punched plate screen installed to the mentioned container, a binnacle out of the container for the mass that has penetrated the punched plate screen and a rotating mixing rotor located into the container and equipped with wings the purpose of which mixing rotor is to defibrate non-degradable paper and mix the mass in the container and that the mixing rotor further comprises a cylinder part rotating along the mentioned rotor and is directed downwards towards the punched plate screen to which cylinder part wings that clean the punched plate screen are attached and which cylinder part is located between the mixing rotor and the punched plate screen.

Previously pulpers that process pulp are known for example from a patent publication FI-118970 in which pulped pulp is processed first with a coarse screen and after that with the help of an auxiliary pulper and their pulp that has penetrated the screen devices is captured from both of them. Dilution water is dosed at several different points to the process. Further from a patent publication FI-119821 a rotor of a pulper is known the distance of the defibration wings of which rotor in relation to the wings cleaning the punched plate screen can be adjusted. The mixer efficiency can thus be brought closer to the punched plate screen, if needed.

With the above described solutions during the pulping of waste paper, REF-material and even sometimes pure bale masses a separate coarse screen or an auxiliary pulper is needed for example due to coarse screening. The aim of the invention is to simplify the pulping of these so that with the help of a rotor solution according to the invention a punched plate screen with such small holes can be installed to the pulper so that the pulper functions at the same time as a coarse screen. For example in the process according to the patent FI-118970 this rotor type removes the need for coarse screening pos. 4.

The rotor type according to the invention is also suitable for the pulping of the pure bale masses because a separate coarse screening or a high consistency cleaning (HC cleaner) is then not needed in the process. Each additional device consumes energy, requires additional investments and maintenance of the devices.

With the pulper according to the invention the above described problems and disadvantages can be solved and it is characteristic for the pulper according to the invention that the pulper comprises a dilution arrangement of the pulp streaming towards the punched plate screen in which dilution arrangement the dilution water is brought along the pipework inside the cylinder part and is directed from the holes of the cylinder part to be mixed with a pulp stream before the mentioned stream has faced the cleaning wings and the screen surface in which case the consistency of the mass is adjusted to be thinner than in the pulping stage while being mixed.

The advantage of the pulper according to the invention is the fact that, when one uses only one punched plate screen in the way according to the invention, holes with a size of 3 mm and also holes smaller than that or corresponding gaps can be used as a hole size of the punched plate screen when the dilution water is directed to the fiberized and cleaned mass, as defined in the invention. At the pulping stage 16 the consistency can be 4-20% depending on the structure and/or the design of the mixing wings 1 and at the mixing stage the value that is under 4% can be reached.

In the following the invention is described more detailed by referring to the accompanying drawing in which the FIG. 1 shows a rotor located in the pulper container as a cut view and a direction arrangement of the dilution water adjusted to it as a side view.

In the FIG. 1 the lower container 3 of the pulper is located into the container 19 supported by the ring flange 6 with the help of a counter-flange 7 from which lower container the mass that has penetrated the punched plate screen 15 of the pulper gets removed through an accept outlet pipe 8. The axle 4 of the pulper goes through the bottom plate 21 and through the bearing unit located on top of it. The mixing wings 1 are attached to the axle 4. The bearing unit is on top of the bottom 21 of the lower container 3 and the axle 4 is rotated from the lower end of the axis.

The mixing rotor to be rotated comprises mixing wings 1 which disintegration wings rotate in the mass space 16 of the container 19 in which mass space the consistency of the mass varies between 4-20% depending on the material to be pulped. A cylinder part 20 directed downwards is attached to a round plate located underneath the mixing wings 1 outside of which cylinder part an annular space 18 is formed. Cleaning wings 2 that clean the punched plate screen 15 and also the ring 14 located higher up are attached to the cylinder part 20 which ring directs the run of the dilution water being directed from the holes 13 of the cylinder part 20 to the annular space 18 located above the cleaning wings 2. The control wings 5 are attached to the plate of the lower side of the rotor, too, which control wings are directed in such a way that when the rotor is rotating they push the mass from the pulping space 16 to the annular space 18. The dilution water is directed along a pipe 9 to a chamber 10 and from there further through the gaps 11 inside the cylinder part 20.

The dilution water is directed to be mixed with the pulp in the annular space 18 immediately above the cleaning wings 2 cleaning the punched plate screen 15 and above the punched plate screen 15. The dilution is specified dilution in the mentioned annular space in which space the consistency of the mass is kept under 4%. Because of this the holes of the punched plate screen 15 can be diminished to be 3 mm or to be smaller gaps. A reject left above the punched plate screen 15 is removed with the help of the cleaning wings 2 from the punched plate screen 15 and it gradually gets removed through an aggregate 17 from the container 19.

The gaps of the punched plate screen 15 can be holes or elongated gaps in which case their advantageous diameter is then 1-3 mm at the narrowest direction and at the longer direction 5-20 mm. Because the holes or the gaps of the punched plate screen 15 have the same size as the holes or gaps usually in a separate coarse screen, in other words 3 mm or smaller, consequently the concerned pulper cleans the mass as well as a separate coarse screen that after this kind of pulper is no longer needed.

Although the rotor axis is described to be vertical in the implementation example, it can also be located in other directions, such as turned from the vertical direction still 45° or in some other position. The dilution water comes out of the cylinder part 20 due to the centrifugal force and/or due to its own overpressure.

The invention claimed is:

1. Pulper used in the paper industry that processes pulp which pulper comprises a pulper container (19), a punched plate screen (15) installed to the mentioned container, an accept outlet pipe (8) out of the lower part (3) of the container for the mass that has penetrated the punched plate screen (15) and a rotating mixing rotor located in the container (19) and equipped with mixing wings (1) and control wings (5) the purpose of which mixing rotor is to defibrate paper and mix the mass in the container (19) and that the mixing rotor further comprises a cylinder part (20) directed downwards towards the punched plate screen (15) and that rotates along the mentioned rotor to which cylinder part (20) cleaning wings (2) that clean the punched plate screen (15) are attached and which cylinder part (20) is located between the mixing wings (1) and the punched plate screen (15), and the control wings (5) are located on the outer edge of the bottom of the mixing wings (1), characterized in that the pulper comprises a dilution arrangement of the pulp that streams towards the punched plate screen (15) in which dilution arrangement the dilution water is brought along the pipework (9) inside the cylinder part (20) and is directed from the gaps (13) of the cylinder part to be mixed with the pulp stream before the mentioned stream has faced the cleaning wings (2) and the punched plate screen (15) in which case the consistency of the mass is adjusted to be thinner than in the pulping space (16) during the mixing.

2. Pulper according to the claim 1, characterized in that the punched plate screen (15) is annular and the inner circle of its screen surface has a diameter that essentially has the size of the diameter of the cylinder part (20) or is bigger than that.

3. Pulper according to the claim 1, characterized in that the mixing of the dilution water with the pulp is adjusted to occur above the cleaning wings (2) with the help of the rotating control wings (5).

4. Pulper according to the claim 1, characterized in that the rotor axle (4) is directed through the punched plate screen (15) and the cylinder part (20).

5. Pulper according to the claim 1, characterized in that the diameter measurement of the holes of the punched plate screen (15) is 3 mm or less.

6. Pulper according to the claim 1, characterized in that the diameter of the holes of the punched plate screen (15) deviating from the round form, being oval or elongated holes, is 1-3 mm at the narrowest direction.

* * * * *